United States Patent [19]

Doak

[11] 4,288,012

[45] Sep. 8, 1981

[54] COATHANGER SUSPENDER

[76] Inventor: Roni K. Doak, 15021 Kimberley La., Houston, Tex. 77079

[21] Appl. No.: 72,947

[22] Filed: Sep. 6, 1979

[51] Int. Cl.[3] ..... A45C 13/26

[52] U.S. Cl. ..... 294/143; 294/159

[58] Field of Search ..... 224/45 R, 45 T, 45 Q, 224/45 P, 313; 248/339, 340; 211/113; 223/85, 88, 95, 98

[56] References Cited

U.S. PATENT DOCUMENTS

| | | | |
|---|---|---|---|
| 2,769,587 | 11/1956 | Threeton | 224/45 T |
| 3,024,953 | 3/1962 | O'Keefe | 223/85 X |
| 3,554,418 | 1/1971 | Holmes | 224/45 T |
| 3,692,218 | 9/1972 | Friedman | 224/45 T |
| 3,774,600 | 7/1973 | Belland et al. | 224/45 T |
| 3,885,723 | 5/1975 | Magnie | 224/45 T |
| 3,961,734 | 6/1976 | Threeton, Sr. | 224/45 T |

*Primary Examiner*—Stephen Marcus

*Attorney, Agent, or Firm*—Michael P. Breston

[57] ABSTRACT

This invention relates to a coathanger suspender for suspending one or more conventional, wire-type coathangers and for providing a handle for carrying the suspended coathangers. The suspender comprises a housing having a handle portion and a magazine portion. The magazine portion is adapted to receive and then lock the hooks of the coathangers. The handle portion allows the hand to comfortably carry the magazine portion, the coathangers, and the garments suspended therefrom in a vertical direction.

3 Claims, 8 Drawing Figures

FIG. 5.
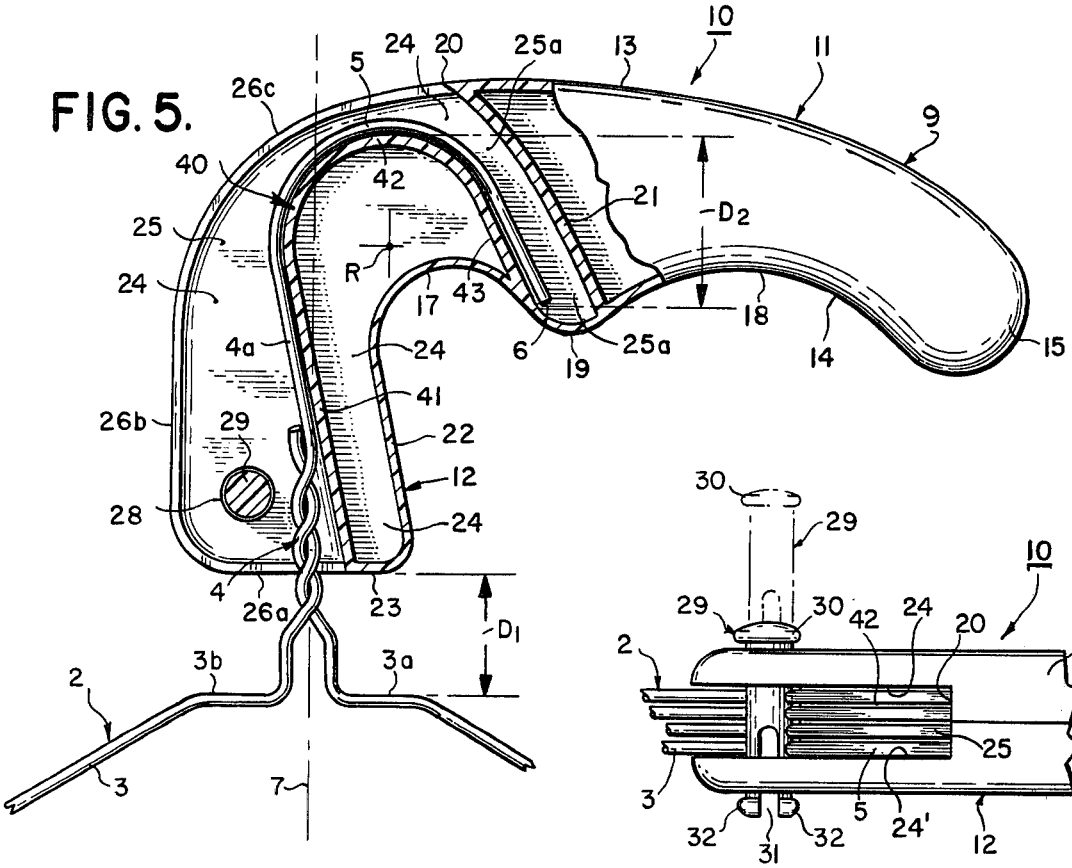
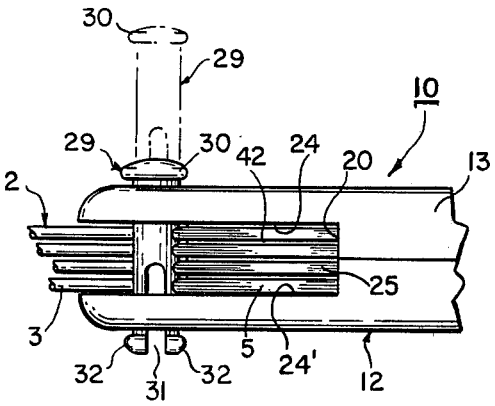
FIG. 6.
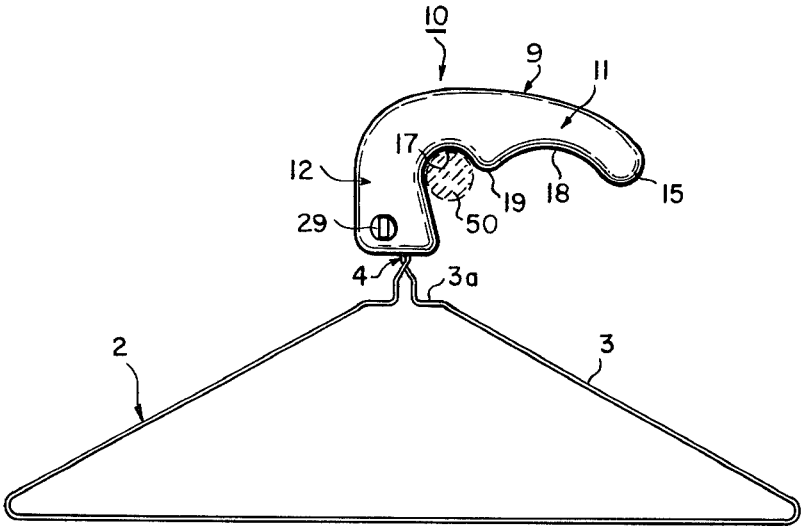
FIG. 7.
FIG. 8.
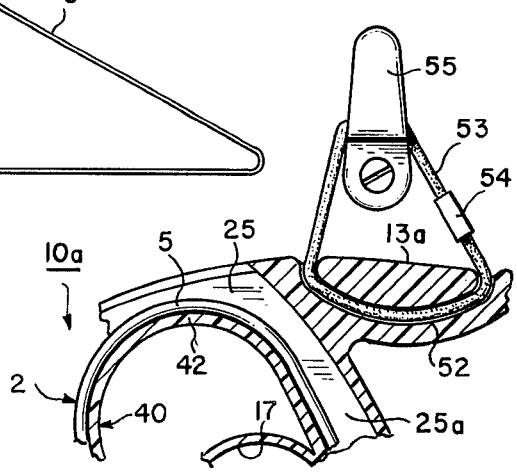

COATHANGER SUSPENDER

BACKGROUND OF THE INVENTION (1) Field of the Invention

This invention relates to a device for hand carrying one or more coathangers and the garments suspended therefrom.

(2) Description of the Prior Art

When garments are picked up from drycleaners or when they are to be transported, for example, on an airplane, they are frequently carried on coathangers, typically of the wire type. A piece of wire is usually wrapped around the assembled hooks of the coathangers which are then carried on one or more handfingers. When so carried for a prolonged time, the hooks can hurt or even cut the fingers.

It is a main object of this invention to provide a handy device which permits to conveniently captivate the hooks of the coathangers in an internal magazine which forms integral part of a streamlined handle that allows the captivated hooks to be carried in a vertical plane with the coathangers resting outside of the device in a normal horizontal plane.

SUMMARY OF THE INVENTION

The coathanger suspender comprises a housing having a rear handle portion and a magazine portion extending forwardly and downwardly of the handle portion. The handle portion is shaped to provide a comfortable gripping surface for the hand.

In the chamber of the magazine portion is a hook wall shaped to generally conform to the hook of a coathanger. The hook wall is transversely positioned within the magazine chamber and is recessed from an outer slot into the magazine chamber, whereby the hook of a coathanger can be freely mounted on and removed from the hook wall through the slot. Releasable retainer means in the magazine chamber are provided for retaining the hook of the coathanger on the hook wall within the magazine chamber. Preferably the retainer means is a pin removably insertable transversely of the magazine chamber between the slot and the hook wall. Also, the magazine chamber forms a close-ended channel, whereby when the hook of the coathanger rests on the hook wall, the outer end of the hook is retained within this channel.

BRIEF DESCRIPTION OF THE DRAWINGS

FIG. 5 is a front view of the suspender with a cutaway of the magazine portion showing the hook of a coathanger mounted on the hook wall;

FIG. 6 is a fragmentary top view showing the slot leading into the magazine chamber, and four hooks supported by the hook wall and retained in the magazine chamber by the locking pin;

FIG. 7 is a front view of the hook suspender carrying a coathanger, the suspender being mounted over and supported by a rod; and FIG. 8 is a partial sectional view showing a modified embodiment having a loop for mounting the suspender on a bracket.

DETAILED DESCRIPTION OF PREFERRED EMBODIMENTS

Figure 1:
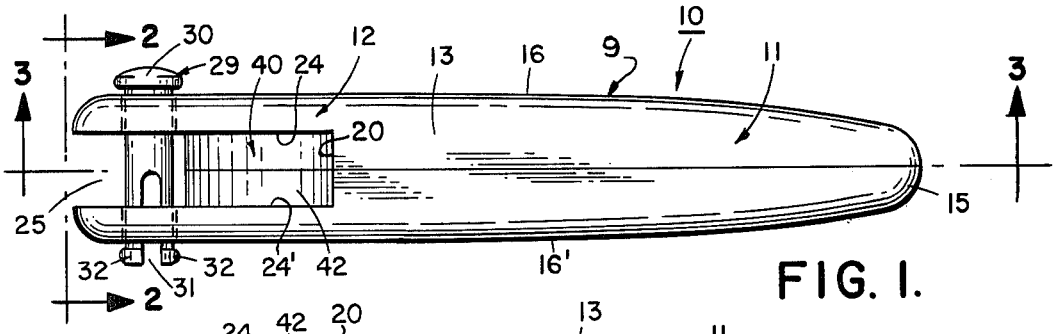
FIG. 1 is a top view of the coathanger suspender of this invention.
Figure 3:
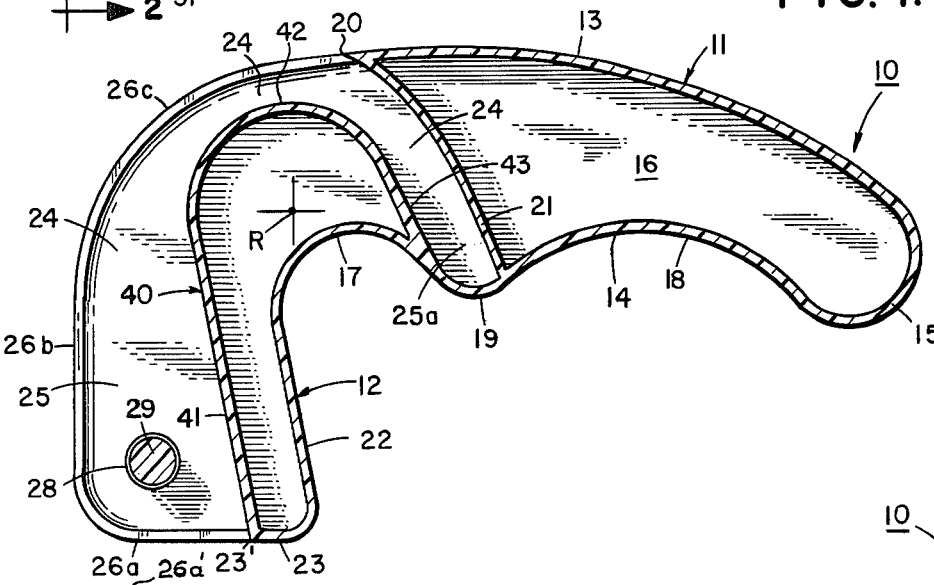
FIG. 3 is a sectional view of the suspender taken on line 3—3 of FIG. 1.
Figure 4:
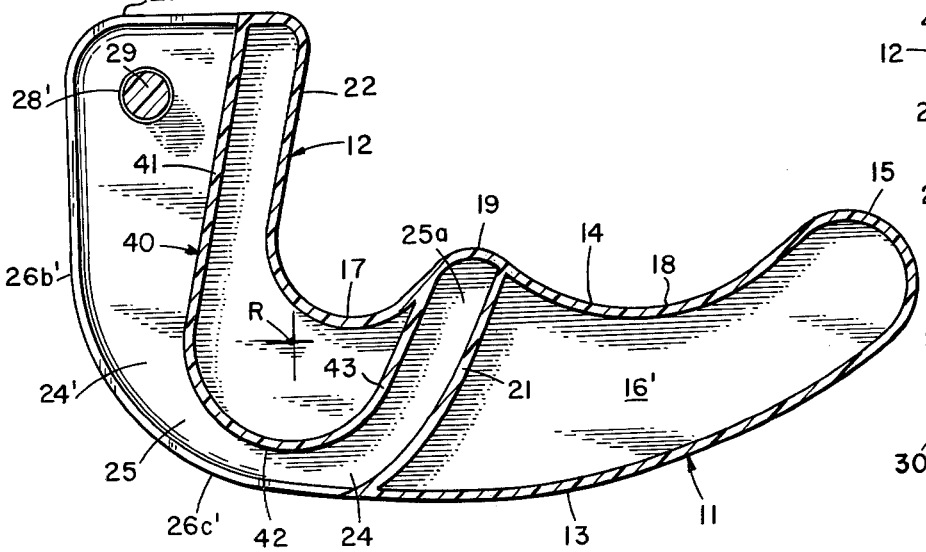
FIG. 4 is a sectional view showing the lower half of the suspender.
Figure 2:
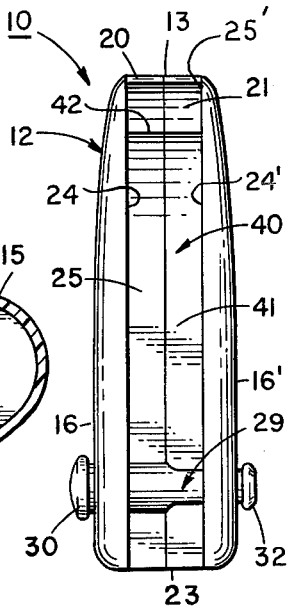
FIG. 2 is a side view taken on line 2—2 of FIG. 1.

With reference in particular to FIGS. 1–4 of the drawings, the coathanger suspender, generally designated as 10, has a housing 9 defining a handle portion 11 and a magazine portion 12. The handle 9 is shaped to be comfortably carried by hand. The magazine portion 12 is adapted for suspending one or more conventional wire-type coathangers 2 (FIG. 7). The magazine portion 12 extends forwardly and downwardly of the handle portion 11 in a vertical plane.

The handle portion has a curved top wall 13, a bottom wall 14, an outer curved wall 15, and side walls 16, 16'. The bottom wall 14 has a concave portion 18 connected to a convex portion 19. A transverse slightly curved wall 21 extends between walls 13–14.

The magazine portion 12 has a slanting vertical side wall 22 connected to a concave portion 17 and to a small horizontal bottom wall 23, and a pair of opposed front and back walls 24, 24' which define therebetween a magazine chamber 25 having an arcuate outer slot 25'. The outer periphery of slot 25' is defined by opposite edges 26*a*, 26*a'*; 26*b*, 26*b'*; 26*c*, 26*c'* and edges 20 and 23'. Walls 24, 24' contain an opposite pair of bores 28, 28', respectively, adapted to slidably receive a retainer pin 29 having a head portion 30 and a slotted locking end portion 31 whose sides have arcuate shoulders 32 adapted to secure pin 29 against accidental falling out.

Across the magazine chamber 25 is a hook wall, generally designated as 40, whose sides form integral part of and are perpendicular to walls 24, 24'. The hook wall 40 is recessed inwardly from the outer edges of chamber slot 25'. Wall 40 has a vertically-extending, rearwardly-slanted wall portion 41 that joins wall 23 at 23'. The bottom portion of wall 41 is generally parallel to the housing side wall 22, and the upper portion 42 of wall 41 is circularly contoured about a center point R. The outer portion 43 of wall portion 42 joins the intersection of wall portions 17 and 19 of handle 11. The wall portion 43 is generally parallel to and is forwardly spaced from slanted wall 21 and forms a closeended channel 25*a* therebetween. Entrance into channel 25*a* is through slot 25'.

In FIG. 5 is shown the suspender 10 supporting a conventional wire coathanger 2 having a triangular frame 3 whose upper parts 3*a*, 3*b* are twisted to form a shank portion, generally designated as 4, followed by a circular hook 5 having an outer end 6. The middle section 4*a* of shank 4 is recessed to the left (as viewed in FIG. 5) from the vertical center line 7 of coathanger 2.

In use, the coathanger 2 hangs vertically from the hook wall 40 while the shank portion 4*a* engages the slanted hook wall portion 41. The circular hook 5 and its outer end 6 engage hook wall portions 42 and 43, respectively. Thus, it will be apparent that the shape of hook wall 40 is preferably matched to the shape of shank 4 and hook 5. Portions 17–19 provide a comfortable finger-gripping surface.

With the retainer pin 29 removed or retracted as shown in FIG. 6, a plurality of coathangers 2 can be easily mounted on or removed from the suspender 10. With the retainer pin 29 engaging holes 28 and 28', a coathanger 2 cannot be accidently removed. Excess vertical displacement of coathanger 2 relative to housing 9 is also prevented by retainer pin 29. Should the magazine portion 12 move down toward shoulders 3*a*, 3*b* of coathanger 2 (FIG. 5), the slanted wall portion 41 of the hook wall 40 would force the retainer pin 29 into contact with the twisted shank portion 4 of the coathanger. The circular hook 5 of the coathanger can move out of slot 25 to a maximum level above housing 9, but the outer end 6 of the hook must remain in the channel 25*a*. This is because, as shown in FIG. 5, the spacing $D_1$ between the bottom wall 23 of the magazine section 12 and the upper shoulder 3*a* of the coathanger 2 is less than the spacing $D_2$ between the crest of circular wall portion 42 of hook wall 40 and the outer end 6 of hook 5. The vertical movements of the coathanger 2 within the magazine chamber 12 can be further limited by positioning the retainer pin 29 closer to the slanted wall portion 41 of the hook wall 40.

Hence, shoulder 3*a* of the coathanger 2 will contact the bottom wall 23 of the magazine section 12, before the outer end 6 of hook 5 can free itself from channel 25*a*.

As shown in FIG. 7, the center of gravity of housing 9 is such that the contoured wall portion 17 of magazine 12 allows the suspender 10 with coathangers carried thereon to be supported from a closet rod member 50 without rotating thereabout.

FIG. 8 shows a modified suspender 10*a* wherein the upper wall 13*a* of handle 11 is made thicker to accommodate a passage 52 for receiving a wire or nylon loop 53 clamped together by a clamp 54. In this fashion, the device 10*a* containing coathangers 2 can be suspended from a courtesy hook or bracket 55 as in an automobile.

What is claimed is:

1. A coathanger suspender comprising:

a housing defining a handle portion shaped to be comfortably carried by hand, and a magazine portion adapted for suspending one or more coathangers and, in use, extending forwardly and downwardly of said handle portion in a vertical plane;

said handle having a curved top wall, an outer wall, side walls, a bottom wall, and a first transverse wall extending between said side walls and being spaced from said outer wall; and said magazine portion having a pair of opposed front and back side walls and a transverse, generally U-shaped hook wall spaced inwardly from the edges of said front and back side walls to form therebetween a magazine chamber having a slot, the outermost end of said hook wall forming with said first transverse wall an inner channel which is in communication through said slot with said magazine chamber whereby, in use, the outer end of the hook of a coathanger is captured through said slot within said inner channel, the curved portion of said hook rests on the curved portion of said hook wall, and the innermost end of said hook of said coathanger resting on the innermost end of said hook wall, so that said handle portion allows the hand of the user to comfortably carry the magazine portion, with the coathanger resting outside of and being easily removable from or mounted on said hook wall.

2. The suspender of claim 1, and releasable retainer means in said magazine chamber for retaining said hook of said coathanger on said hook wall within said magazine chamber.

3. The suspender of claim 2, wherein said retainer means is a pin removably insertable transversely of said magazine chamber.

* * * * *